US007305995B2

(12) United States Patent
Tojo et al.

(10) Patent No.: US 7,305,995 B2
(45) Date of Patent: Dec. 11, 2007

(54) HAIR HOLDER

(75) Inventors: Takehiko Tojo, Tochigi (JP); Hideo Kobayashi, Tochigi (JP)

(73) Assignee: Kao Corporation, Tokyo (JP)

( * ) Notice: Subject to any disclaimer, the term of this patent is extended or adjusted under 35 U.S.C. 154(b) by 0 days.

(21) Appl. No.: 10/522,192

(22) PCT Filed: Jul. 22, 2003

(86) PCT No.: PCT/JP03/09270

§ 371 (c)(1),
(2), (4) Date: Aug. 2, 2005

(87) PCT Pub. No.: WO2004/010817

PCT Pub. Date: Feb. 5, 2004

(65) Prior Publication Data

US 2006/0032513 A1 Feb. 16, 2006

(30) Foreign Application Priority Data

Jul. 25, 2002 (JP) ..... 2002-216105

(51) Int. Cl.
*A45D 2/00* (2006.01)

(52) U.S. Cl. ..... 132/222

(58) Field of Classification Search ..... 132/222, 132/221, 270, 246, 247
See application file for complete search history.

(56) References Cited

U.S. PATENT DOCUMENTS

| | | | | | |
|---|---|---|---|---|---|
| 2,906,273 | A * | 9/1959 | Beauregard | ..... | 132/205 |
| 2,936,766 | A * | 5/1960 | Beverly | ..... | 132/247 |
| 3,545,457 | A * | 12/1970 | Schepis | ..... | 132/222 |
| 5,799,669 | A * | 9/1998 | Briggs | ..... | 132/208 |
| 5,813,419 | A * | 9/1998 | Brams | ..... | 132/222 |
| 5,849,421 | A * | 12/1998 | Stephan | ..... | 428/603 |

FOREIGN PATENT DOCUMENTS

| | | |
|---|---|---|
| JP | 11-14546 | 10/1936 |
| JP | 35-11355 | 5/1960 |
| JP | 44602/1981 | 4/1981 |
| JP | 12103/1982 | 1/1982 |
| JP | 61-38481 | 11/1986 |
| JP | 6-37762 | 10/1994 |
| JP | 10-192036 | 7/1998 |
| WO | 00/57744 | 10/2000 |

* cited by examiner

*Primary Examiner*—Todd E. Manahan
(74) *Attorney, Agent, or Firm*—Oblon, Spivak, McClelland, Maier & Neustadt, P.C.

(57) ABSTRACT

A hair holder 1 having a flat tube 2 composed of a sheet 23A and a sheet 23B in such a design that a strand of hair is inserted from an opening 21 at one end thereof to an opening 22 at the other end thereof. The sheet 23A composed of one side of the tube 2 has a plurality of sheet openings 25 that are long in the width direction of the tube 2 and are arranged with a space in the length direction of the tube 2. The tube 2 has substantially no extensibility in its length direction.

14 Claims, 5 Drawing Sheets

HAIR HOLDER

TECHNICAL FIELD

The present invention relates to a hair holder that is used as a tool for rolling a strand of hair when the hair is treated by permanent waving and the like.

BACKGROUND ART

A conventional hair holder composed by a sheet material is disclosed, e.g., in Japanese Utility Model Publication No. 14546/36, but it is cumbersome for hair handling. In order to improve handling and hair curling, JP-A-10-192036 proposes a tubular hair rolling tool and a method of hair rolling. This tubular hair rolling tool has a great merit in that a strand of hair can be handled much more easily.

However, the inner and the outer sheets of the tubular hair roller has deformation which is generated during hair rolling process. The amount of the deformation becomes greater in proportion to the amount of hair inserted in the tubular hair holder and increase of a curvature of hair to be rolled. If hair is curled without eliminating the deformation, it will not be curled into an orderly ring shape but an disorderly polygonal shape.

WO 00/57744 discloses a tubular hairdressing tool for hair curling by permanent waving, etc., which is composed of a mesh sheet and has extensibility in longitudinal and transverse directions. A strand of hair is inserted into the tubular hairdressing tool after the tubular hairdressing tool is extended in the transverse direction and contracted in the longitudinal direction. The tube is extended, then twisted at two or more positions together with the hair, and maintained in that state for a prescribed period of time to curl the hair.

However, while or after a strand of hair is inserted into the tube, the tip of the hair tends to be bent backward or irregularly waved due to decrease of the tube diameter and the hair has no beautiful curling.

DISCLOSURE OF THE INVENTION

Accordingly, an object of the present invention is to provide a hair holder with which hair can be curled easily, securely, and orderly.

The prevent invention, in its first aspect, accomplishes the above object by providing a hair holder having a flat tube composed of a sheet. The hair holder of the prevent invention has entrance opening and end opening. A strand of hair can be inserted from the entrance opening at one end thereof toward the end opening at the other end. The sheet which composes one side of the tube has a plurality of sheet openings that are long in the width direction of the tube and are arranged with a space along the length direction of the tube. The tube has substantially no extensibility in its length direction.

The present invention, in its second aspect, accomplishes the above object by providing a hair holder having a flat tube composed of a sheet. The hair holder of the prevent invention has entrance opening and end opening. A strand of hair can be inserted from the entrance opening at one end thereof toward the end opening at the other end thereof. One side of the tube is composed of a sheet having a Taber stiffness of 0.4 mN·m or less. The sheet which composes the side of the tube has a plurality of attachment pieces that are long in the width direction of the tube with spacing along the length direction of the tube. The tube has substantially no extensibility in its length direction.

BEST MODE FOR CARRYING OUT THE INVENTION

Figure 1:
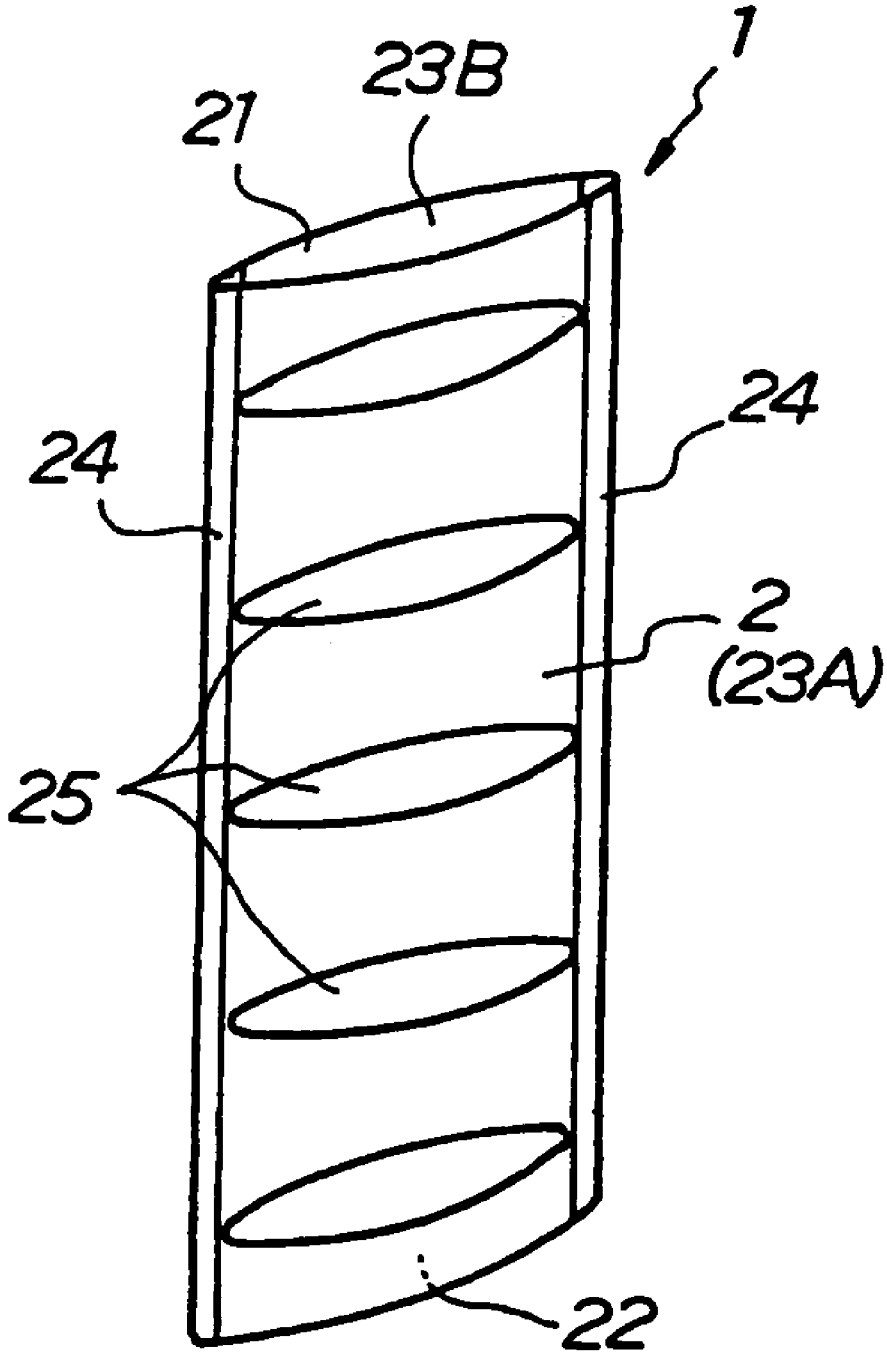
FIG. 1 is a perspective view of a hair holder according to a first embodiment of the first aspect of the present invention.

The hair holder of the first aspect of the invention will be described with reference to its preferred first embodiment by way of FIGS. 1 and 2*a* through 2*d*.

As shown in FIGS. 1 and 2*a* through 2*d*, the hair holder 1 of the first embodiment has a flat tube 2. The flat tube 2 is composed of sheets 23A and 23B in such a design that a hair strand 3 can be inserted from an entrance opening 21 toward an end opening 22. The sheet 23A which composes one side of the tube 2 has a plurality of (five) sheet openings 25 that are long in the width direction of the tube 2 (i.e., the transverse direction of FIG. 1). The openings 25 are arranged with a space along the length direction of the tube 2 (i.e., the vertical direction in FIG. 1). The tube 2 has substantially no extensibility in its length direction.

The hair holder 1 of the first embodiment will hereinafter be described in greater detail.

The tube 2 is made of two rectangular sheets 23A and 23B by bonding their long side edges 24 to each other. Five elliptical sheet openings 25 are provided in one of the sheets, i.e., the sheet 23A.

Preferable dimensions of the tube 2 are 50 to 350 mm of length, 20 to 100 mm of major axis, and 0 to 30 mm of minor axis. These dimensions are properly selected according to the length of hair, the part of hair to be curled, and the amount of hair to be inserted.

Figure 3:
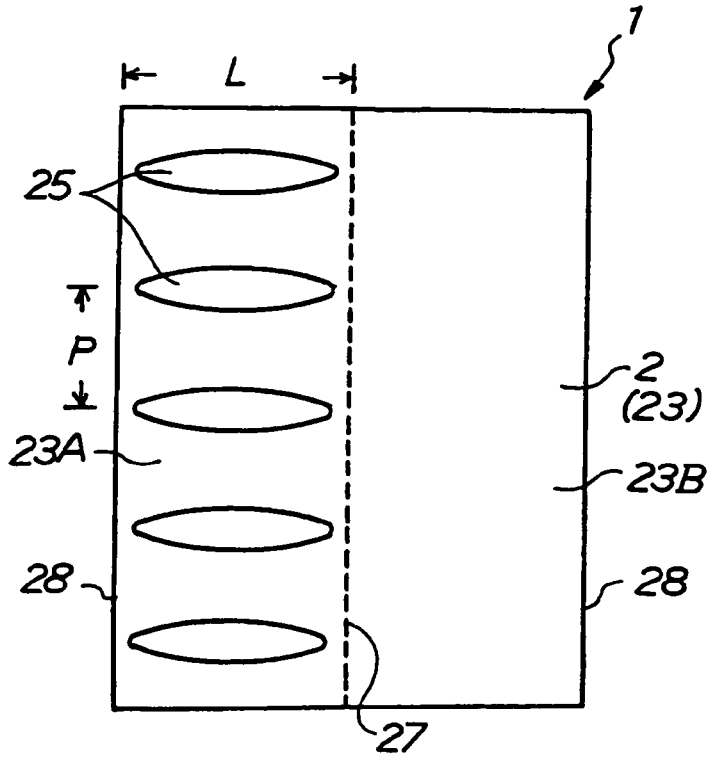
FIG. 3 is a perspective view of a hair holder according to a second embodiment of the first aspect of the present invention.

The sheet openings 25 extendover a length of at least ⅔ of the width of the sheet 23A (length L indicated in FIG. 3, the length of the sheet in the width direction). In the first embodiment, the length of the opening 25 is 80 to 90% of the length L. It is preferred that the sheet openings 25 be arranged at a regular interval over the entire length of the sheet. In this particular embodiment, the pitch P (see FIG. 3) of the sheet openings 25 is 2 to 50 mm.

The tube 2 has substantially no extensibility in its longitudinal direction. If the tube 2 has extensibility in the longitudinal direction, the tip of the hair tends to be bent backward or irregularly waved while or after the hair strand 3 is inserted into the tube 2.

In the hair holder 1 of the first embodiment, the sheet 23A of the tube 2, i.e., the sheet with the sheet openings 25, preferably has a Taber stiffness of 0.4 to 10 mN·m. The sheet 23B, the sheet which composes the other side of the tube 2 (the sheet with no openings), may be either a hard one with a Taber stiffness of 0.4 mN·m or higher or a soft one with a Taber stiffness of 0.4 mN·m or lower. The sheet 23B is preferably a slightly hard one, specifically one having a Taber stiffness of 0.4 to 5.0 mN·m. Where the two sheets 23A and 23B have the same Taber stiffness, the Taber stiffness of the two sheets preferably ranges from 0.4 to 10 mN·m.

The sheet openings can be formed by punching one of the sheets to make desired holes or by adhering a plurality of pieces of arbitrary shape to the sheets 23A.

If the sheets 23A and 23B of the tube 2 have a Taber stiffness of not greater than 0.4 mN·m, a hair holder 1 having a stiffener (for example, a plastically deformable member described later) at the center portion of the tube 2 enables to obtain more orderly cured hair. If the sheets 23A and 23B of the tube 2 have a Taber stiffness of 1.0 to 5.0 mN·m, the tube without the stiffener can easily be deformed by the hand. A tube with a moderate Taber stiffness offers a secondary advantage that the hair strand inserted into the tube hardly deviates from an appropriate position in the tube.

The Taber stiffness is measured in accordance with the stiffness testing method specified in JIS P8125.

Various flexible materials can be used for the sheets 23A and 23B. Useful flexible materials include nonwoven fabrics (e.g., polyethylene nonwoven fabric and polyethylene terephthalate nonwoven fabric), woven fabrics, porous or non-porous resin films (e.g., polyethylene film and polyethylene terephthalate film), paper, polymer sheets, rubber sheets, and composites of these materials. In this particular embodiment, a nonwoven fabric permeable to a hair treating agent for permanent waving is used.

Although the thickness of the sheets 23 is depend on its Taber stiffness, a preferable thickness is from 30 μm to 500 μm.

A usage of the hair holder according to the first embodiment of the first aspect of the invention will be described with respect to curling hair by permanent waving referring to FIGS. 2*a* through 2*d*.

Figure 2A:
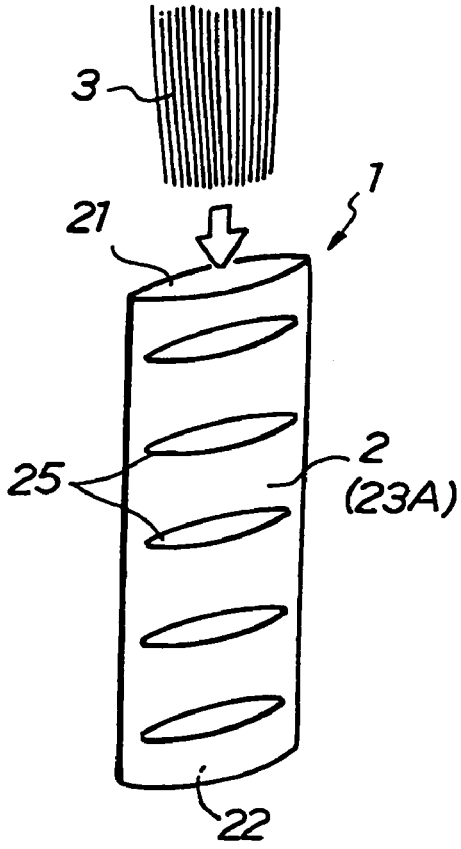
FIG. 2*a*, FIG. 2*b*, FIG. 2*c*, and FIG. 2*d* illustrate a usage of a hair holder according to the first embodiment of the first aspect of the present invention, each representing a perspective view showing the way of rolling up a hair strand.
Figure 2B:
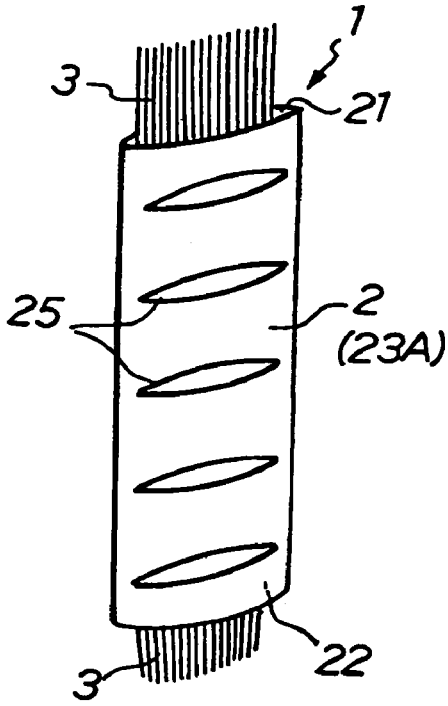
Figure 2C:
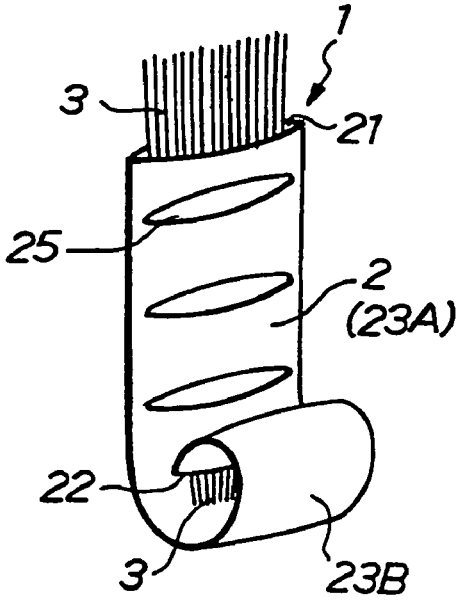
Figure 2D:
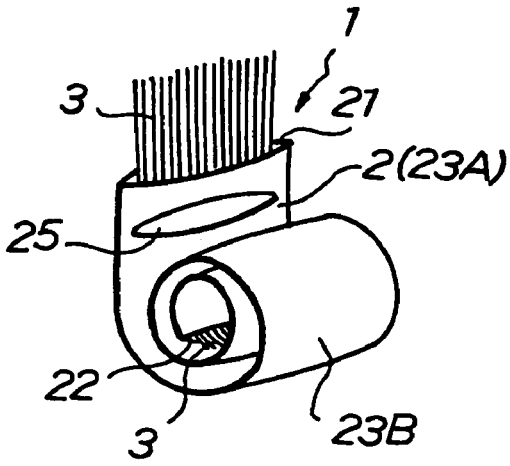

First of all, a hair holder 1 having a tube 2 with appropriate length and width is chosen according to the amount of a hair strand 3 or a desired curling style. As shown in FIG. 2*a*, the entrance opening 21 of the tube 2 is widened to make an elliptic shape, and a hair strand 3 is inserted from the entrance opening 21. As shown in FIG. 2*b*, the hair strand 3 is passed through the tube 2 until the tip of the stand slightly sticks out of the end opening 22 of the tube 2.

After the hair strand 3 is inserted into the tube 2, the hair holder 1 is rolled up from the end opening 22 with a desired starting diameter as depicted in FIGS. 2(*c*) and 2(*d*). The hair strand 3 is kept in the rolled state by means of a well-known fixing member, such as a clip (not shown). Thereafter a hair treating agent for permanent waving is applied to the hair strand 3 from the outside of the tube 2. The hair treating agent is supplied to the hair strand 3 via the sheets 23 permeable to the hair treating agent or through the sheet openings 25. After an elapse of an appropriate time, the hair strand 3 is released from the tube 2 and subjected to post-treatment such as shampooing to complete permanent waving.

In rolling up a hair strand 3 using the hair holder 1 of the first embodiment, the tube 2 may be rolled up with the sheet openings 25 either in or out. It is preferred, however, that the tube 2 be rolled up with the sheet 23A (having openings 25) in as illustrated in FIGS. 2*a* through 2*d* so as to obtain a desired neat curl.

If necessary, the entrance opening 21 of the tube 2 is widened into a circular shape when a hair strand 3 is inserted into the tube 2 to insert the hair strand 3 more smoothly. The hair strand 3 does not always need to be inserted until its tip sticks out of the end opening 22 of the tube 2.

The hair holder 1 of the first embodiment has a plurality of sheet openings 25 which are arranged with a space in the sheet 23A composed of one side of the hair holder 1 in the length direction of the sheet 23A. The tube 2 has substantially no extensibility in its length direction and is composed of sheets having a Taber stiffness of 1.0 to 5.0 mN·m. Therefore, when a hair strand 3 is inserted into the tube 2 of the hair holder 1 of the first embodiment, a pressure force is put to the hair strand 3 and the hair strand is hardly pulled out of the hair holder 1. That is, the hair holder 1 surely holds the hair strand at a proper position. In rolling up the hair strand 3, because the tube 2 can smoothly be bent at the sheet openings 25, the tube 2 having the hair strand 3 inserted can be rolled up smoothly with a circular shape. Since the tube 2 does not extend while or after the hair strand 3 is inserted, the hair hardly suffers from retrorse or irregular curling. Besides, the tube 2 has a proper stiffness without the aid of a stiffener. Therefore, hair can be curved easily, surely and orderly by use of the hair holder 1 of the present embodiment.

Second to eighth embodiments of the hair holder of the first aspect of the present invention will then be described only with respect to differences from the first embodiment. The description of the first embodiment applies appropriately to those particulars that are not described here. Similarly to the hair holder of the first embodiment, the hair holders according to these other embodiments make it possible to curl hair easily, surely, and neatly.

As illustrated in FIG. 3, the hair holder 1 of the second embodiment has its tube 2 fabricated of one rectangular sheet 23 (23A plus 23B). The sheet 23 is folded into two along the center line 27, and the two opposing long side edges 28 are bonded together to form the tube 2. Otherwise, the hair holder of the second embodiment has the same structure as the one according to the first embodiment.

Figure 4A:
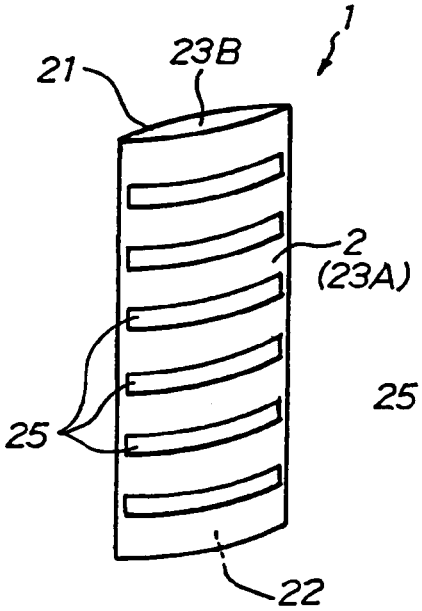
FIG. 4*a*, FIG. 4*b*, and FIG. 4*c* are each a perspective view of a hair holder according to a third, a fourth, and a fifth embodiment, respectively, of the first aspect of the present invention.

In the hair holder 1 of the third embodiment shown in FIG. 4*a*, the sheet 23A has six rectangular sheet openings 25. Otherwise, the hair holder 1 of the third embodiment has the same structure as the one according to the first embodiment.

Figure 4B:
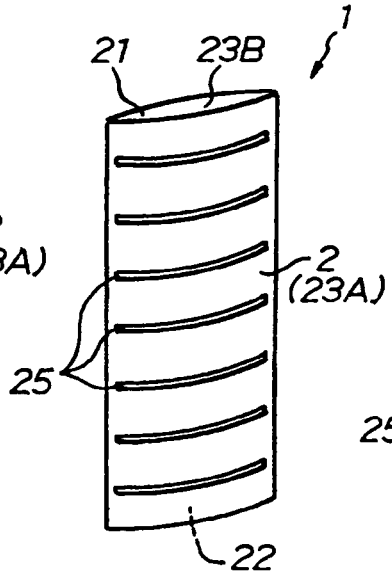

In the hair holder 1 of the fourth embodiment shown in FIG. 4*b*, the sheet 23A has seven slits as sheet openings 25. Otherwise, the hair holder 1 of the fourth embodiment has the same structure as the one according to the first embodiment. Where the hair holder having a tube with slits as in the fourth embodiment has the slits (openings) at irregular intervals, the hair holder can curl a hair strand with an irregular curling diameter and with smooth curves.

Figure 4C:
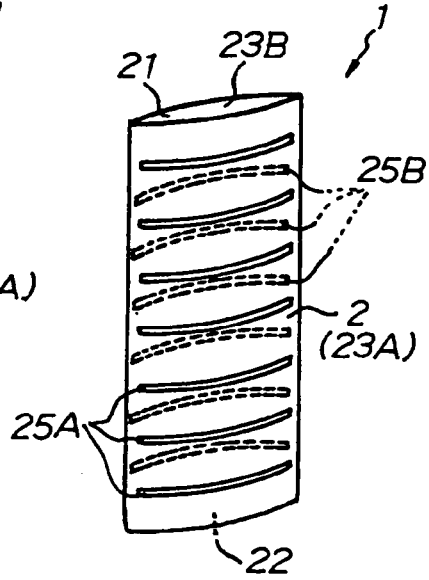

The hair holder 1 of the fifth embodiment is shown in FIG. 4*c*. In this hair holder, the sheet 23A composed of one side of the tube 2 has seven sheet openings 25A that are slits long in the width direction of the tube 2 and arranged in the length direction of the tube 2 at spaced intervals. The sheet 23B composed of the other side of the tube 2 also has six sheet openings 25B that are slits long in the width direction of the tube 2 and arranged in the length direction of the tube 2 at spaced intervals. The sheet openings 25A and the sheet openings 25B are arranged alternately in the length direction of the tube 2.

In the fifth embodiment, the strain due to deformation for hair curling can be relaxed in both sides. As a result, the tube even with fewer openings can be rolled up into a orderly shape.

Figure 5A:
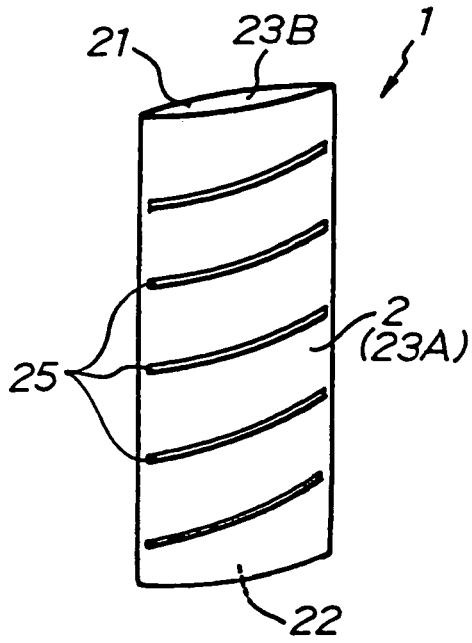
FIG. 5*a* and FIG. 5*b* are each a perspective view of a hair holder according to a sixth and a seventh embodiment, respectively, of the first aspect of the present invention.

The hair holder 1 of the sixth embodiment shown in FIG. 5*a* has five slit openings 25 cut in the sheet 23A forming one side of the tube 2. The sheet openings 25 are oblique to the length direction of the tube 2 and arranged with a space in the length direction of the tube 2.

Hair can be curled spirally with the hair holder having a tube with oblique slit openings as in the sixth embodiment.

Figure 5B:
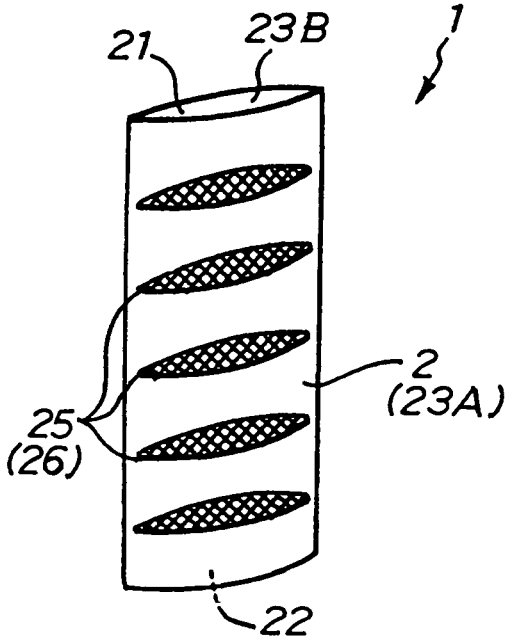

As shown in FIG. 5*b*, the hair holder 1 of the seventh embodiment has a mesh sheet 26 having a Taber stiffness of 0.4 mN·m or less (tensioned sheet) applied to the sheet openings 25 of the first embodiment.

In the hair holder of the seventh embodiment, the tube 2 can be surely rolled up and the tensioned sheet prevents the tip of the hair from projecting out of the sheet openings 25.

Figure 6A:
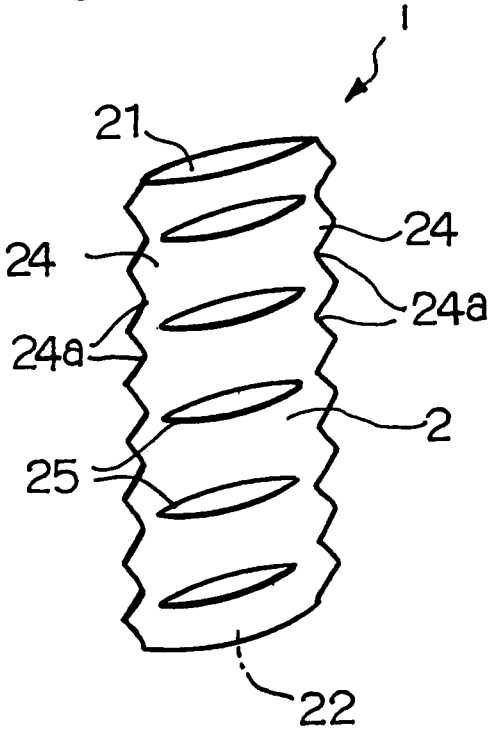
FIG. 6*a* and FIG. 6*b* illustrate a hair holder according to an eighth embodiment of the first aspect of the present invention, representing perspective views before and after rolling up hair, respectively.

In the hair holder 1 of the eighth embodiment, as shown in FIG. 6*a*, the tube 2 has indentations 24*a* at intervals of a moderate distance in its both long side edges 24. The indentations 24*a* illustrated in FIG. 6*a* have a sharp edge at the bottom, however, the bottom does not need to have the sharp edge as long as the bottom may be gripped by a rubber band, etc.

Figure 6B:
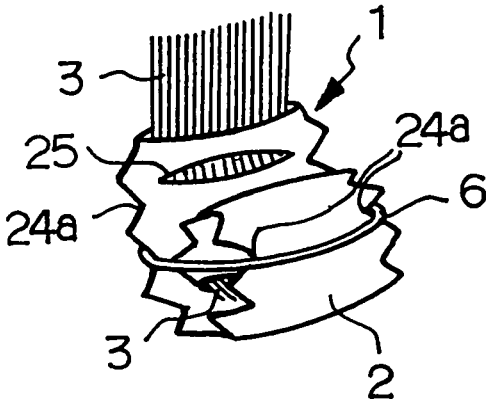

According to the eighth embodiment, a hair strand can easily be maintained in a rolled state by putting a rubber band 6 over the tube 2 at the indentations 24*a* as shown in FIG. 6*b*.

The hair holder of the second aspect of the present invention will now be described with its preferred embodiments, i.e., ninth and tenth embodiments, by way of FIGS. 7*a* and 7*b*. The hair holder of the second aspect will be described only with reference to differences from that of the first aspect of the invention. Accordingly, the description of the first aspect applies appropriately to those particulars that are not described here.

Figure 7A:
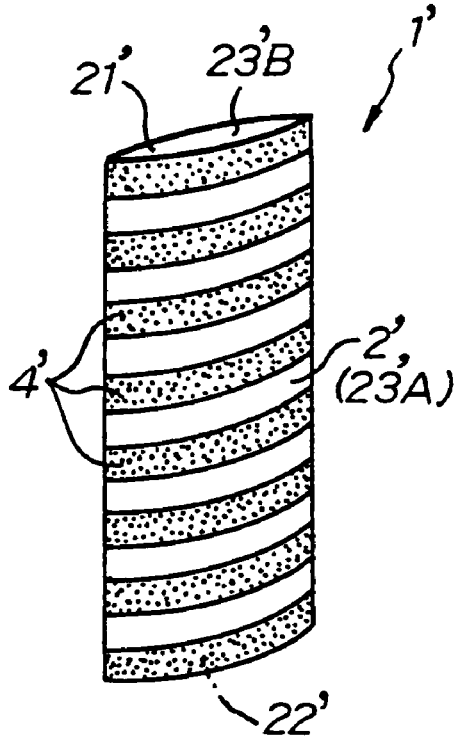
FIG. 7*a* and FIG. 7*b* are perspective views of hair holders according to a ninth embodiment and a tenth embodiment, respectively, of the second aspect of the present invention.

As shown in FIG. 7*a*, the hair holder 1' of the ninth embodiment has a flat tube 2' designed such that a strand of hair can be inserted from the entrance opening 21' to the end opening 22'. One side of the tube is formed of a sheet 23'A having a Taber stiffness of 0.4 mN·m or less. Eight attachment pieces 4' adhere to the tube 2' with spacing along the length direction of the tube 2'. The tube 2' has substantially no extensibility in its length direction.

The tube 2' is made of two rectangular sheets 23'A and 23'B by bonding their long side edges to each other. Each of the attachment pieces 4' is rectangular and extends over the whole width of the sheet 23'A composed of one side of the tube 2'.

Figure 7B:
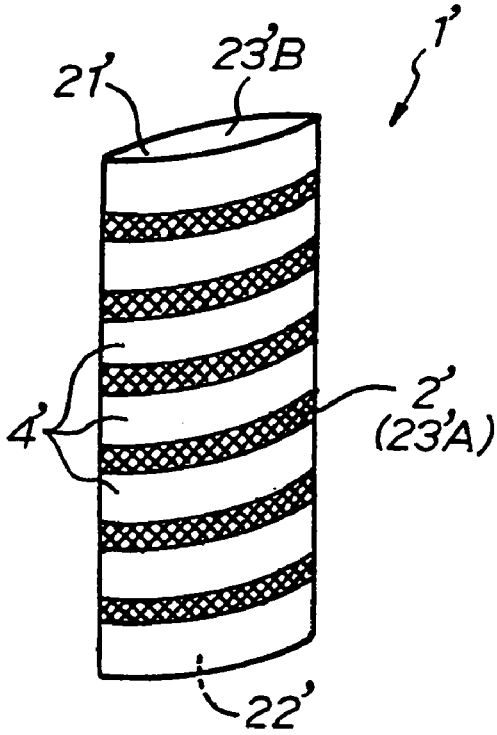

In the hair holder 1' of the tenth embodiment, the tube 2' is formed of a rectangular mesh sheet 23'A having a Taber stiffness of 0.4 mN·m or less and a rectangular sheet 23'B with no holes and having a Taber stiffness of 0.4 mN·m or more by bonding their long side edges to each other as shown in FIG. 7*b*. Seven rectangular attachment pieces 4 adhere to the rectangular mesh sheet 23'A with a space along the length direction of the tube 2'.

Another composition of the hair holder of the tenth embodiment is the same as that of the ninth embodiment.

According to the second aspect of the present invention, the parts of the tube with no attachment pieces serve the same function as the sheet openings of the tube of the first aspect of the invention. The hair holder of the second aspect can be used as the same manner as that of the first aspect and produces as the same effects as the first aspect.

The hair holder of the present invention, inclusive of the first and the second aspects, is not limited to the aforementioned embodiments, and various modifications, such as those described below, can be made thereto without departing from the scope of the present invention.

Figure 8:
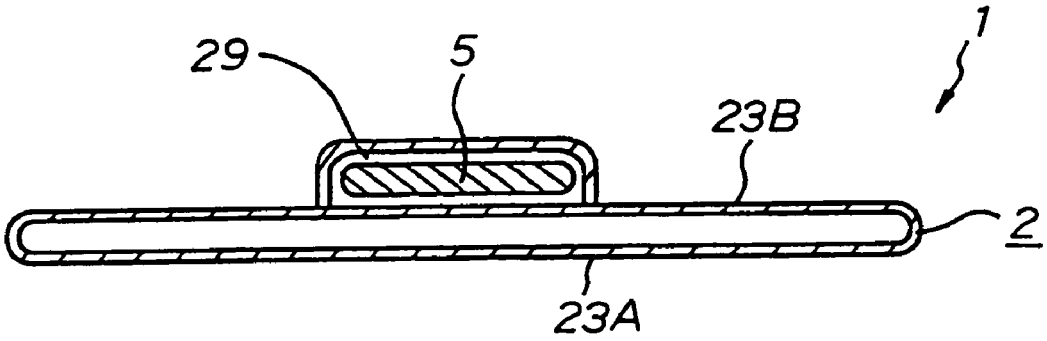
FIG. 8 is a schematic cross-sectional view of a hair holder according to another embodiment of the present invention.

The hair holder of the present invention can have a plastically deformable member attached to the tube along the tube's length direction. As shown in FIG. 8, the sheet 23B may be provided with a flat tubular bag 29 to hold a plastically deformable member 5. The plastically deformable member 5 is slidable in the bag 29 and the member 5 and the tube 2 may be movable relative to each other. When the hair holder having such a plastically deformable member is rolled up with a hair strand in, the plastically deformable member is plastically deformed to suppress the restoring force of the hair strand in the tube.

As long as the tube of the hair holder of the present invention does not substantially have extensibility as a whole, a part of the sheet(s) composed of the tube may have extensibility. A liquid impermeable sheet can be used as a sheet of the tube.

The tube has two open ends, however, one of the open ends may have closing means. The method of manifacture of the tube is not particularly restricted. For instance, the tube may be manufactured by sewing, fusion bonding or adhesion of the sheets, or the tube may be manufactured by extrusion techniques or the like.

The sheet openings may be formed on only one side of the tube as in the above-described embodiments except the fifth embodiment shown in FIG. 4*c*. The other side of the tube may also have sheet openings in the same or different configuration from that on the opposite side.

Each different elements of the foregoing embodiments may be altered or combined appropriately to create another embodiments.

The shape and the surface condition of the sheet or sheets of the tube of the hair holder of the present invention are not limited as long as the sheet can be shaped into a tubular form having the above-described structure. The sheet may have a rough surface.

The method of making the sheet openings in the tube is not particularly limited. For example, a sheet material is cut or punched to make the sheet openings. The shapes of the sheet openings are not limited to an ellipse or a rectangle as in the first to the sixth embodiments and include a slit in the width direction of the tube.

The manner of using the hair holder according to the present invention is not limited to the usage of the hair holder of the first embodiment illustrated in FIGS. 2*a* to 2*d*. The hair holder may be used in combination with a curling rod as has conventionally been used in rolling up a hair strand. The hair holder of the present invention can be applied to hair curling not only by permanent waving but by applying heat with a dryer, etc. to rolled hair, maintaining a dry hair strand in a rolled-up state, or maintaining a wet hair strand in a rolled-up state to let the hair dry spontaneously. The hair holder can also be applied to not only curling the tip of hair but curling hair in a zig-zag or spiral form.

Hair may be curled in the above-described methods after applying a commercially available hair grooming product thereto.

INDUSTRIAL APPLICABILITY

Hair can be curled easily, surely and orderly with the hair holder of the present invention.

The invention claimed is:

1. A hair holder that is used as a tool for rolling a strand of hair, comprising:

a flat tube having a first side and a second side and formed of at least one sheet in such a design that the strand of hair can be inserted from a first end opening at one end thereof to a second end opening at the other end thereof, wherein a sheet of the first side of the tube has a plurality of sheet openings that are long in a width direction of the tube and are arranged with a space in the length direction of the tube, the tube has substantially no extensibility in the length direction thereof, the plurality of sheet openings that are long in the width direction of the tube, extend over a length of at least ⅔ of a width of the sheet forming the first side, and are arranged at a pitch of 2 to 50 mm, and the plurality of sheet openings are configured to allow the hair holder to be smoothly rolled up.

2. The hair holder according to claim 1, wherein the sheet openings are ellipses, rectangles, or slits.

3. The hair holder according to claim 1, wherein a sheet forming the second side of the tube has a Taber stiffness of 0.4 mN·m or more.

4. The hair holder according to claim 1, having a sheet having a Taber stiffness of 0.4 mN·m or less applied in tension to the sheet openings.

5. The hair holder according to claim 1, wherein the tube is formed of two rectangular sheets, the two sheets being joined together along long side edges thereof, and one of the two sheets having the sheet openings.

6. The hair holder according to claim 1, having a plastically deformable member attached to the tube along the length direction of the tube.

7. The hair holder according to claim 6, wherein the plastically deformable member is movable relative to the tube.

8. The hair holder according to claim 1, wherein the tube has indentations at spaced intervals on opposite long side edges thereof.

9. A hair holder, comprising:

a flat tube having a first side and a second side and formed of at least one sheet in such a design that a strand of hair can be inserted from a first end opening at one end thereof to a second end opening at the other end thereof, wherein the first side of the tube is formed of a sheet having a Taber stiffness of 0.4 mN·m or less, the sheet forming the first side of the tube having adhered thereto a plurality of attachment pieces that are long in a width direction of the tube at spaced intervals along a length direction of the tube, and the tube having substantially no extensibility in the length direction thereof.

10. A method of curling hair, comprising:

placing the hair to be curled into a hair holder, the hair holder including a flat tube having a first side and a second side and formed of at least one sheet in such a design that the strand of hair can be inserted from a first end opening at one end thereof to a second end opening at the other end thereof, wherein a sheet of the first side of the tube has a plurality of sheet openings that are long in a width direction of the tube and are arranged with a space in the length direction of the tube, the tube has substantially no extensibility in the length direction thereof, and the plurality of sheet openings are long in the width direction of the tube, extend over a length of at least ⅔ of a width of the sheet forming the first side, and are arranged at a pitch of 2 to 50 mm;

rolling up the hair holder with the hair inside to a desired starting diameter;

keeping the hair holder in a rolled state with a fixing member;

applying a hair treating agent to the hair via the hair holder; and releasing the hair from the hair holder after a predetermined amount of time.

11. The method of curling hair of claim 10, wherein the applying the hair treating agent via the hair holder includes applying the hair treating agent via sheets of the hair holder that are permeable to the hair treating agent.

12. The method of curling hair of claim 10, wherein the applying the hair treating agent via the hair holder includes applying the hair treating agent via openings in at least one of the sheets of the hair holder.

13. The method of curling hair of claim 10, wherein the rolling up the hair holder includes rolling up the hair holder with openings in a sheet of the hair holder facing inward from the rolled up hair holder.

14. A method of curling hair, comprising:

placing the hair to be curled into a hair holder, the hair holder including a flat tube having a first side and a second side and formed of at least one sheet in such a design that a strand of hair can be inserted from a first end opening at one end thereof to a second end opening at the other end thereof, wherein the first side of the tube is formed of a sheet having a Taber stiffness of 0.4 mN·m or less, the sheet forming the first side of the tube having adhered thereto a plurality of attachment pieces that are long in a width direction of the tube at spaced intervals along a length direction of the tube, and the tube having substantially no extensibility in the length direction thereof;

rolling up the hair holder with the hair inside to a desired starting diameter;

keeping the hair holder in a rolled state with a fixing member;

applying a hair treating agent to the hair via the hair holder; and releasing the hair from the hair holder after a predetermined amount of time. the tube, and the tube having substantially no extensibility in the length direction thereof.

* * * * *